United States Patent [19]

Huntoon

[11] 4,197,024

[45] Apr. 8, 1980

[54] ACOUSTICAL DAMPING FOR PRINTER

[75] Inventor: Francis E. Huntoon, Des Plaines, Ill.

[73] Assignee: Teletype Corporation, Skokie, Ill.

[21] Appl. No.: 856,066

[22] Filed: Nov. 30, 1977

[51] Int. Cl.[2] ..... B41J 13/02

[52] U.S. Cl. ..... 400/636; 400/636.3; 400/641; 400/661; 400/662; 400/689

[58] Field of Search ..... 400/219.5, 636, 636.3, 400/637, 637.3, 637.4, 639, 639.1, 641, 661, 661.1, 662, 689; 101/93, 14

[56] References Cited

U.S. PATENT DOCUMENTS

| | | | |
|---|---|---|---|
| 636,941 | 11/1899 | Barron | 400/662 |
| 944,746 | 12/1909 | Rice | 400/641 |
| 1,098,840 | 6/1914 | Rennie | 400/641 |
| 1,418,506 | 6/1922 | Wood | 400/662 X |
| 1,427,909 | 9/1922 | Peterson | 400/639 |
| 2,152,858 | 4/1939 | Becker | 400/639.1 |
| 2,244,095 | 6/1941 | Botham et al. | 400/662 X |
| 2,561,453 | 7/1951 | Von Duyke | 400/639.1 |
| 3,742,848 | 7/1973 | Huntoon et al. | 101/93.14 |
| 3,825,103 | 7/1974 | Riley | 400/219.5 |

FOREIGN PATENT DOCUMENTS

| | | | |
|---|---|---|---|
| 677518 | 6/1939 | Fed. Rep. of Germany | 400/637 |

OTHER PUBLICATIONS

IBM Technical Disclosure Bulletin, "Polyurethane Foam Formulation and Process," McSpadden, vol. 19, No. 9, Feb. 1977, p. 3238.

*Primary Examiner*—Ernest T. Wright, Jr.
*Attorney, Agent, or Firm*—A. A. Tirva; J. C. Albrecht

[57] ABSTRACT

An apparatus for damping the acoustical impact noise traveling along a length of paper as it passes through a printer including resilient urethane foam rollers in engagement with a large proportion of the width of the paper with a pressure damping roller depressing portions of the paper deeply into engagement with the resilient roller to enable the resilient roller to damp acoustical energy traveling along the length of the paper.

4 Claims, 2 Drawing Figures

ACOUSTICAL DAMPING FOR PRINTER

FIELD OF THE INVENTION

The present invention relates to noise control in an impact printing mechanism and more particularly to damping the acoustical noise tending to propogate along the record medium of an impact printer.

BACKGROUND OF THE INVENTION

In impact type printing mechanisms of the type shown in U.S. Pat. No. 3,742,848 granted to F. E. Huntoon et. al. on July 3, 1973, and U.S. Pat. No. 3,825,103 granted to A. F. Riley on July 23, 1974, an inked ribbon and a paper record medium are squeezed together by the impact of a moving print hammer and a type pallet. The shock from this impact has a tendency to propogate along the length of the paper. The paper record is advanced from a source roll or a fan-fold bin, past the printing station, and over a paperfeed roller. The paper is under slight tension as it passes through the printing station. Paper leaving the feed roller exits through an opening in the printer cabinet and may well continue to be under slight tension as it is pulled into a fan-fold pile or is pulled onto a take-up reel.

The acoustical energy of the shock of each print hammer striking the paper is thus carried along the length of the paper much as voices are carried along a taut string stretched between two paper cups. This impact noise carried outside of the printer cabinet on the paper tends to radiate from the paper since the length of paper extending outside of the printer cabinet radiates acoustical energy somewhat like the cone of a loud speaker and broadcasts this noise into the room.

SUMMARY OF THE INVENTION

In accordance with the present invention, acoustical noise propagating along the length of a record medium is minimized by passing the record medium over a resilient roller and depressing the record medium along the principal portion of its width into the resilient material.

BRIEF DESCRIPTION OF THE DRAWING

A more complete understanding of the present invention may be had by referring to the following detailed description when considered in conjunction with the accompanying drawing wherein.

DETAILED DESCRIPTION

Figures 1, 2:
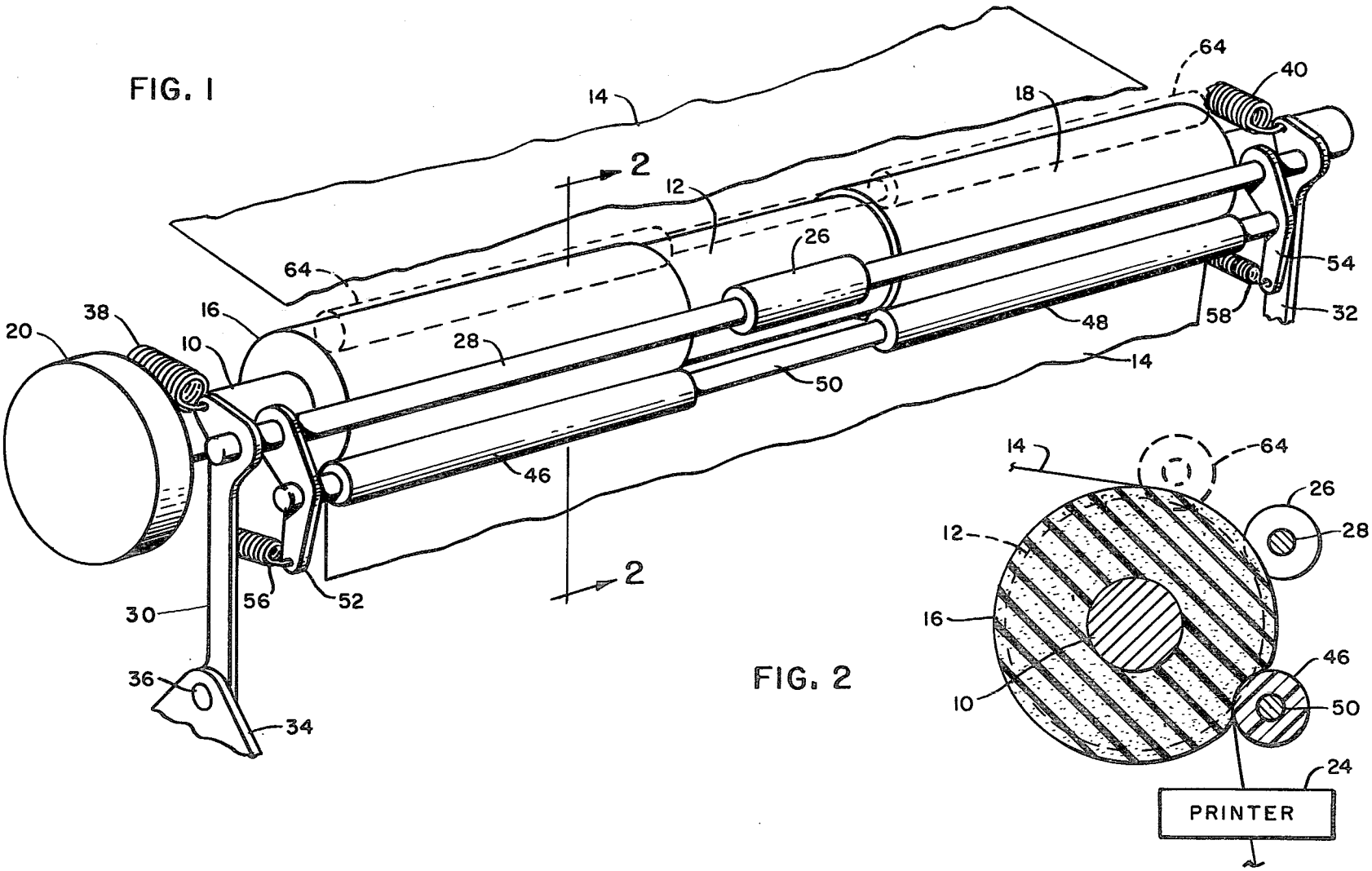
FIG. 1 is a schematic view in perspective of a paper-feed roller constructed according to the present invention.
FIG. 2 is a cross-sectional view of the paper-feed roller taken along line 2—2 in FIG. 1.

Referring now to the accompanying drawing and more particularly to FIG. 1, a drive shaft 10 spans the printing mechanism and has firmly mounted thereto a neophrene feed roller 12 near the center of a paper record medium 14. The neophrene feed roller 12 is of conventional typewriter platen material and of approximately the same hardness, but spans only a very narrow width of the printer. The purpose of the small length of the neophrene feed roller or capstan 12 which is coaxial with the drive shaft 10 is to engage the center portion of the paper record medium 14 for advancing the paper 14 through the printing mechanism. The neophrene roller 12 must be relatively rigid so as to maintain a desired pitch diameter in order to advance the paper 14 by a finite, precise amount with each angular increment of the shaft 10.

A pair of damping rollers 16 and 18 are also mounted on the drive shaft 10 and fixed thereto. The damping rollers 16 and 18 are constructed preferably of a closed cell urethane foam which is relatively resilient and particularly, is substantially more flexible than the neophrene of the feed roller 12. Preferably, the damping rollers 16 and 18 are constructed of four-pound urethane foam (four pounds per cubic foot) manufactured by Scott Paper Company, Foam Division, and sold under the trade name Pyrell.

The drive shaft 10 is suitably mounted within the framework of the printing apparatus for rotation with respect thereto in order to feed the paper 14. The shaft 10 and with it the rollers 12, 16, and 18 are rotated in precisely controlled angular increments by a drive means 20. The drive means 20 can be any of a number of known selective incremental rotational drive mechanisms such as a stepping motor, a ratchet, or a clutch-brake combination, without limitation.

The paper 14, shown schematically in FIG. 1 as well as in cross-sectional view FIG. 2, passes from a printing station or printer 24 as described in the abovementioned patents to Huntoon et al. and Riley. The paper 14 then passes for a substantial angular distance around the rollers 12, 16, and 18.

In order to assure that sufficient friction exists between the paper 14 and the neophrene feed roller 12, a pressure roller 26 is mounted on a pressure rod 28 which spans the printing mechanism. The pressure rod 28 is mounted in a pair of pressure support arms 30 and 32. Preferably, the pressure roller 26 is freely rotatable about the rod 28. However, it is possible to fix the pressure roller 26 firmly to the rod 28 and make the rod 28 rotatable within the support arms 30 and 32.

The pressure support arms 30 and 32 are mounted for rotation with respect to the frame of the printer which is represented in conjunction with the arm 30 by a support 34 and a pivot 36. A pair of springs 38 and 40 urge the support arms 30 and 32 to rotate in a counterclockwise direction as viewed from the left of FIG. 1 about their pivots, such as the pivot 36, in order to press the pressure roller 26 against the paper 14 and press the paper 14 into engagement with the neophrene feed roller 12.

Two damping pressure rollers 46 and 48 are mounted on a damping pressure rod 50 which spans the printing mechanism. The damping pressure rollers 46 and 48 are positioned opposite the damping rollers 16 and 18, respectively. The damping pressure rollers 46 and 48 can be either rotatably mounted on the damping pressure rod 50 or can be firmly fixed to the damping pressure rod 50. In fact, the damping pressure rollers 46 and 48 can be machined from the same piece of material from which the rod 50 is machined.

The rod 50 is mounted either fixedly or rotationally to a pair of arms 52 and 54. The arms 52 and 54 are rotatably mounted on the rod 28. A pair of springs 56 and 58 are arranged to urge the arms 52 and 54 to rotate in a clockwise direction, as viewed from the left of FIG. 1, about the rod 28 in order to urge the damping pressure rollers 46 and 48 into engagement with the paper 14 and to press the paper 14 deeply into the surface of each of the damping rollers 16 and 18.

Referring now to FIG. 2, as the paper 14 issues from the printer 24, the damping pressure roller 46 presses the paper 14 deeply into the surface of the damping roller 16 in order to obtain substantial area of contact between the paper 14 and the damping roller 16. The paper 14 wraps around a substantial arc length of the surface of the damping pressure roller 46. The paper 14, as it continues in its path counterclockwise (in FIG. 2) about the rollers 12 and 16, is pressed by the pressure roller 26 onto the hard surface of the neophrene feed roller 12. There is negligible deflection of the neophrene feed roller 12. However, sufficient friction between the paper 14 and the feed roller 12 is provided by the force of the pressure roller 26 that as the shaft 10 rotates, the neophrene feed roller 12 advances the paper 14 with it.

Improved noise reduction can be obtained if space permits by employing a second pair of damping pressure rollers 64 arranged to press the paper 14 deeply into another part of the surface of the damping rollers 16 and 18.

Although only one specific embodiment of the invention is shown in the drawing, and described in the foregoing specification, it will be understood that invention is not limited to the specific embodiment described, but is capable of modification and rearrangement and substitution of parts and elements without departing from the spirit and scope of the invention.

What is claimed:

1. An impact printer comprising:

a printing station including a printing mechanism for impact printing indicia on a record medium advancing through the printing station, and apparatus positioned to receive the printed record medium for reducing the noise generated by the printing mechanism when printing indicia on the record medium and traveling along the record medium exiting from the printing station; the apparatus comprising:

a main roller made of a resilient material along the principal portion of its length so as to accept a substantial depression for receiving the printed record medium, and the remainder of said main roller being made of a less resilient material so as to accept a negligible depression, means for rotating said main roller, means for pressing the printed record medium against the less resilient portion of the main roller so as to frictionally engage and move the printed record medium as the main roller rotates, and means for depressing the printed record medium along the principal portion of its width into said resilient portion of said main roller as the printed record medium advances through the noise reducing apparatus.

2. A mechanism according to claim 1 wherein the resilient portion of the main roller comprises a closed-cell urethane foam cylinder having an outer diameter larger than the diameter of the less resilient portion of the main roller.

3. A mechanism according to claim 2 wherein the closed-cell urethane foam cylinder is made of four-pound urethane foam.

4. An impact printer comprising:

a frame for supporting the impact printer, a printing station including a printing mechanism for impact printing indicia on a record medium advancing through the printing station, apparatus positioned to receive the printed record medium for reducing the noise generated by the record medium when printing indicia on the record medium and traveling along the record medium exiting from the printing station; the apparatus comprising:

a main roller having first and second resilient portions having substantially equal lengths and outer diameters and arranged to accept a substantial depression for receiving the printed record medium, a less resilient portion of the main roller having a length and an outer diameter less than the length and the outer diameter, respectively, of the first and second resilient portions of the main roller and located between the first and second resilient portions of the main roller, means for rotating said main roller, means for pressing the printed record medium into engagement with the less resilient portion of the main roller so as to frictionally engage and move the printed record medium as the main roller rotates; the pressing means comprising:

a pressure roller having a length less than the length of the less resilient portion of the main roller, the pressure roller mounted on a pressure rod and positioned opposite the less resilient portion of the main roller, the pressure rod in turn being mounted on a pair of pressure support arms pivoted to the frame of the printer, each pressure support arm being connected to a spring for urging the pressure rod and thus the pressure rollers against the less resilient portions of the main roller, and means for depressing the printed record medium into engagement with the resilient portions of the main roller, the depressing means comprising:

a first and second damping pressure roller mounted on a damping pressure rod and positioned opposite the first and second resilient portions of the main roller, respectively, each damping pressure roller having a length substantially equal to the length of the resilient portion of the main roller opposite each damping pressure roller, the damping pressure rod in turn being mounted on a pair of support arms pivoted on the pressure support arms, each support arm being connected to a spring for urging the damping pressure rollers towards the resilient portions of said main roller.

* * * * *